US010105944B2

(12) United States Patent
Yoneta

(10) Patent No.: US 10,105,944 B2
(45) Date of Patent: Oct. 23, 2018

(54) LIQUID DISCHARGE HEAD, LIQUID DISCHARGE DEVICE, AND LIQUID DISCHARGE APPARATUS

(71) Applicant: Ryohta Yoneta, Kanagawa (JP)

(72) Inventor: Ryohta Yoneta, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/670,138

(22) Filed: Aug. 7, 2017

(65) Prior Publication Data

US 2018/0072066 A1 Mar. 15, 2018

(30) Foreign Application Priority Data

Sep. 14, 2016 (JP) ..... 2016-179602
Jul. 4, 2017 (JP) ..... 2017-131184

(51) Int. Cl.

| | |
|---|---|
| ***B41J 2/14*** | (2006.01) |
| ***B41J 2/01*** | (2006.01) |
| ***B41J 2/175*** | (2006.01) |
| *B41J 2/18* | (2006.01) |

(52) U.S. Cl.

CPC ..... *B41J 2/01* (2013.01); *B41J 2/14145* (2013.01); *B41J 2/17563* (2013.01); *B41J 2/18* (2013.01); *B41J 2002/14306* (2013.01)

(58) Field of Classification Search

CPC ..... B41J 2/01; B41J 2/14145; B41J 2/17563; B41J 2002/14306; B41J 2/18

See application file for complete search history.

(56) References Cited

U.S. PATENT DOCUMENTS

2012/0098900 A1* 4/2012 Xie ..... B41J 2/1404 347/85
2013/0233948 A1 9/2013 Yoneta
2014/0071215 A1* 3/2014 Yoneta ..... B41J 2/17563 347/93
2014/0218450 A1 8/2014 Yoneta
2014/0253648 A1 9/2014 Yoneta
2015/0015646 A1 1/2015 Yoneta
2015/0077471 A1 3/2015 Yoneta

FOREIGN PATENT DOCUMENTS

| | | |
|---|---|---|
| JP | 2010-173205 | 8/2010 |
| JP | 2014-043032 | 3/2014 |
| JP | 2014-046515 | 3/2014 |

* cited by examiner

*Primary Examiner* — Yaovi M Ameh
(74) *Attorney, Agent, or Firm* — Oblon, McClelland, Maier & Neustadt, L.L.P.

(57) ABSTRACT

A liquid discharge head, includes a plurality of nozzles from which a liquid is discharged, a plurality of individual-liquid-chambers that communicate with the plurality of nozzles, a supply-side common-liquid-chamber to supply the liquid to the plurality of individual-liquid-chambers, a plurality of drainage channels that communicate with the plurality of nozzles, a drainage-side common-liquid-chamber to drain the liquid in the plurality of drainage channels, a supply-side filter disposed upstream from the plurality of nozzles in a liquid flow direction in which the liquid flows through the liquid discharge head; and a drainage-side filter disposed downstream from the plurality of nozzles in the liquid flow direction.

18 Claims, 17 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2016-179602, filed on Sep. 14, 2016 and Japanese Patent Application No. 2017-131184, filed on Jul. 4, 2017 in the Japan Patent Office, the entire disclosures of which are hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid from nozzles, for example, a circulation-type head is known that supplies liquid to an individual-liquid-chamber to discharge liquid from the nozzles. The circulation-type head returns and circulates liquid that has not been discharged from the nozzles from a liquid drainage channel to a drainage-side common-liquid-chamber, thereby to enhance the performance of discharging bubbles having entered the individual-liquid-chamber and minimize changes in the properties of the liquid.

SUMMARY

In an aspect of this disclosure, a novel liquid discharge head, includes a plurality of nozzles from which a liquid is discharged, a plurality of individual-liquid-chambers that communicate with the plurality of nozzles, a supply-side common-liquid-chamber to supply the liquid to the plurality of individual-liquid-chambers, a plurality of drainage channels that communicate with the plurality of nozzles, a drainage-side common-liquid-chamber to drain the liquid in the plurality of drainage channels, a supply-side filter disposed upstream from the plurality of nozzles in a liquid flow direction in which the liquid flows through the liquid discharge head, and a drainage-side filter disposed downstream from the plurality of nozzles in the liquid flow direction. In another aspect of this disclosure, a novel liquid discharge head, includes a plurality of nozzles from which a liquid is discharged, a plurality of individual-liquid-chambers to communicate with the plurality of nozzles, respectively, a supply-side common-liquid-chamber to supply the liquid to the plurality of individual-liquid-chambers, a plurality of drainage channels to communicate with the plurality of individual-liquid-chambers, respectively, a drainage-side common-liquid-chamber to drain the liquid in the plurality of drainage channels, a supply-side filter disposed between the plurality of nozzles and the supply-side common-liquid-chamber, and a drainage-side filter disposed between the plurality of the nozzles and the drainage-side common-liquid-chamber.

In still another aspect of this disclosure, a liquid discharge device includes a liquid discharge head.

In still another aspect of this disclosure, a liquid discharge apparatus includes a liquid discharge device, and a conveyor to convey a medium to the liquid discharge head.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
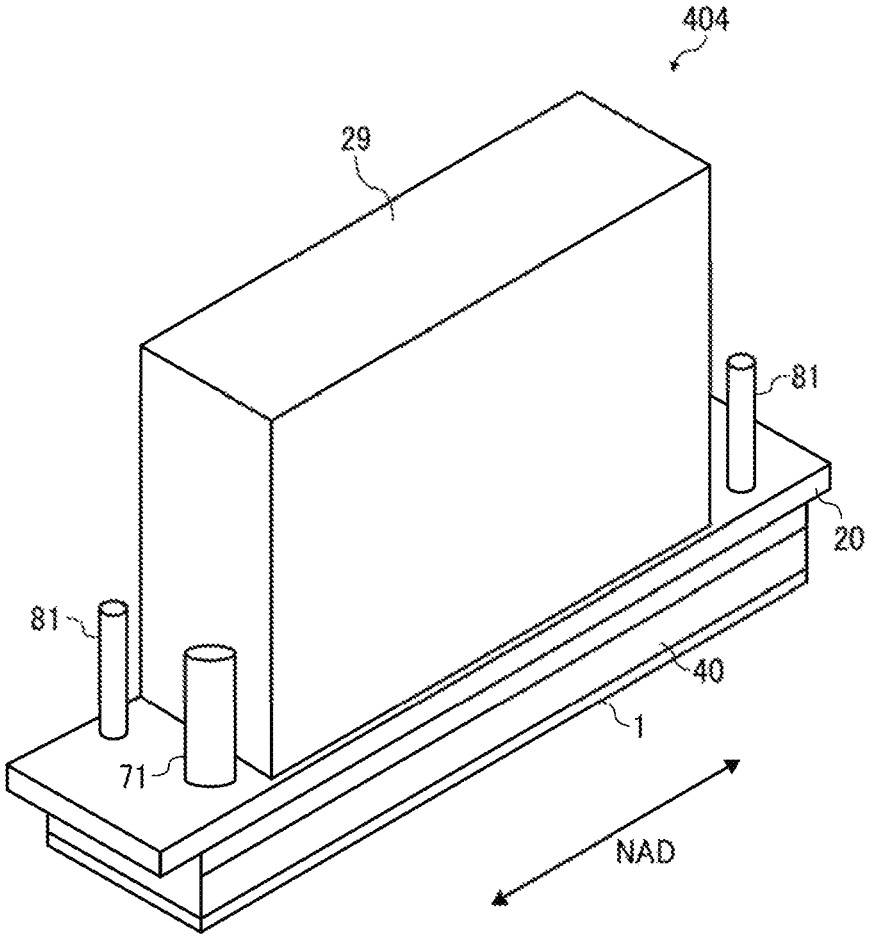
FIG. 1 is an outer perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

Below, embodiments of the present disclosure are described with reference to the attached drawings.

Figure 2:
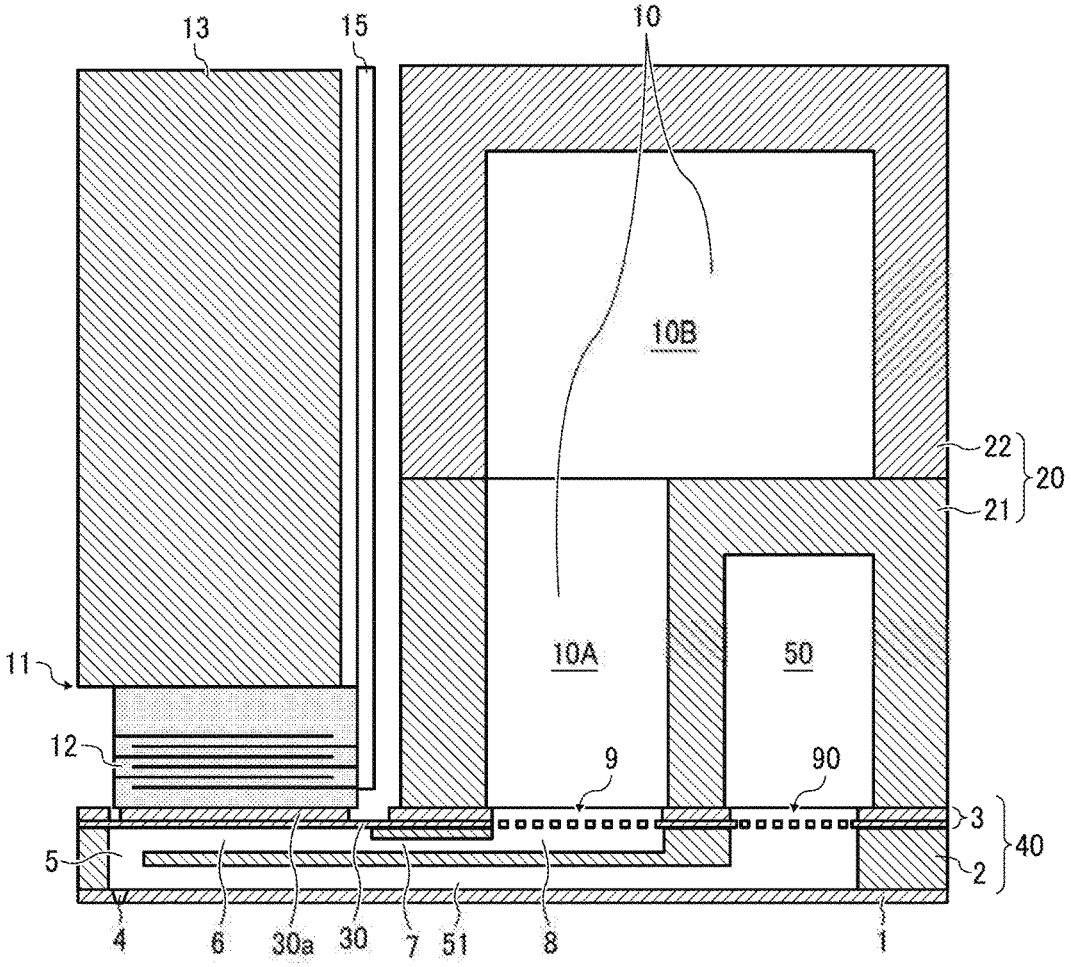
FIG. 2 is a cross-sectional view of the liquid discharge head of FIG. 1 in a direction perpendicular to a nozzle array direction in which nozzles are arrayed in row (a longitudinal direction of an individual-liquid-chamber)
Figure 3:
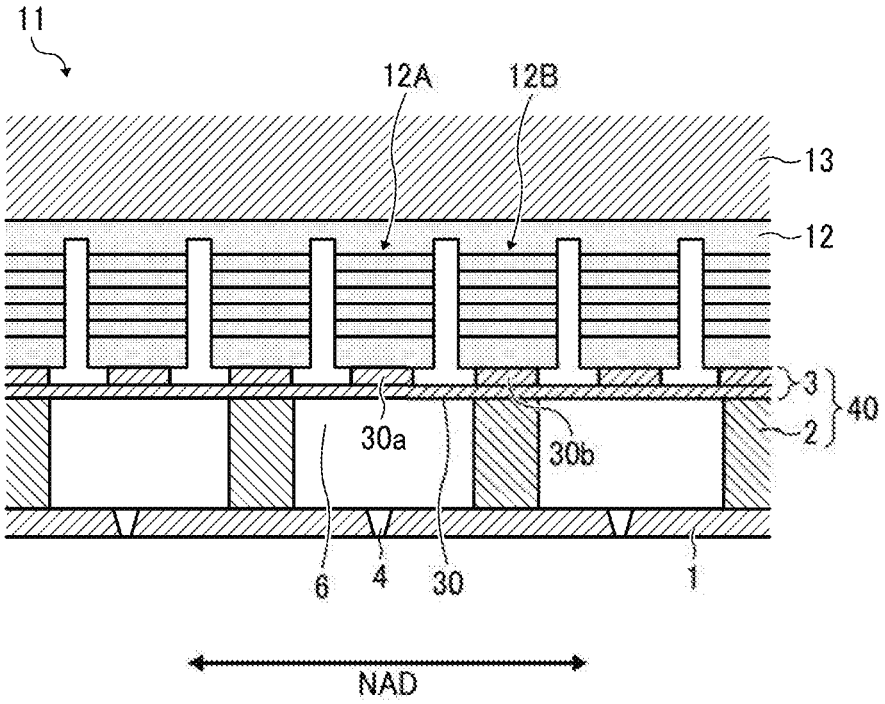
FIG. 3 is a cross-sectional view of the liquid discharge head of FIG. 1 in the nozzle array direction (a transverse direction of an individual-liquid-chamber)

FIGS. 1 to 3 illustrate a liquid discharge head according to a first embodiment of the present disclosure. FIG. 1 is a schematic perspective view of the liquid discharge head. FIG. 2 is a cross-sectional view of the liquid discharge head of FIG. 1 cut in a direction perpendicular to a nozzle array direction NAD (a longitudinal direction of individual-liquid-chamber 6). FIG. 3 is another cross-sectional view of the liquid discharge head of FIG. 1 cut in the nozzle array direction NAD.

As illustrated in FIGS. 2 and 3, a liquid discharge head 404 includes a nozzle plate 1, a channel substrate 2, and a diaphragm member 3 (diaphragm) that acts as a wall member. The nozzle plate 1, the channel substrate 2, and the diaphragm member 3 are laminated one on another and bonded to each other to form a channel member 40. The liquid discharge head 404 includes piezoelectric actuators 11 to displace vibration portions 30 of the diaphragm member 3, a common-liquid-chamber substrate 20 as a frame member, and a cover 29. The nozzle plate 1 includes a plurality of nozzles 4 to discharge liquid.

The channel substrate 2 includes through-holes and grooves (slots) that form a nozzle communication channel 5 communicated with the nozzles 4, individual-liquid-chambers 6 communicated with the nozzles 4 via the nozzle communication channel 5, supply-side fluid restrictors 7 communicated with the individual-liquid-chambers 6, and liquid introduction portions 8 communicated with the supply-side fluid restrictors 7. The nozzle communication channel 5 is a flow channel that is continuous and communicated with each of the nozzles 4 and the individual-liquid-chambers 6.

The diaphragm member 3 includes the deformable vibration portions 30 that form a part of a wall surface of the individual-liquid-chambers 6 of the channel substrate 2. In the present embodiment, the diaphragm member 3 has a two-layer structure including a first layer including thin portions that face the channel substrate 2 and a second layer including thick portions which are projections 30*a* that are island-shaped thick portions of the vibration portions 30 of the diaphragm member 3. The first layer of the diaphragm member 3 includes the deformable vibration portions 30 at positions corresponding to the individual-liquid-chambers 6. Note that the diaphragm member 3 is not limited to the two-layer structure and the number of layers may be any other suitable number.

The piezoelectric actuators 11 include electromechanical transducer elements as driving devices (actuator devices or pressure generators) to deform the vibration portions 30 of the diaphragm member 3. The piezoelectric actuators 11 are disposed at a first side of the diaphragm member 3 opposite a second side facing the individual-liquid-chambers 6.

The piezoelectric actuator 11 includes piezoelectric members 12 bonded on a base 13. The piezoelectric members 12 are groove-processed by half cut dicing so that each piezoelectric members 12 includes a desired number of pillar-shaped piezoelectric elements 12A and pillar-shaped piezoelectric elements 12B that are arranged in certain intervals to have a comb shape.

In the first embodiment, the piezoelectric elements 12A of the piezoelectric member 12 are piezoelectric elements to be driven by application of drive waveforms, and the piezoelectric elements 12B are used as supports to which no drive waveform is applied. In some embodiments, all of the piezoelectric elements 12A and the piezoelectric elements 12B may be piezoelectric elements to be driven by application of drive waveforms.

The piezoelectric elements 12A are bonded to projections 30*a* that are island-shaped thick portions of the vibration portions 30 of the diaphragm member 3. The piezoelectric elements 12B are bonded to projections 30*b* that are thick portions of the diaphragm member 3.

The piezoelectric member 12 includes piezoelectric layers and internal electrodes alternately laminated. The internal electrodes are led out to an end face of the piezoelectric member 12 to form external electrodes. The external electrodes are connected to a flexible wiring member 15.

The common-liquid-chamber substrate 20 includes a supply-side common-liquid-chamber 10 and a drainage-side common-liquid-chamber 50.

As illustrated in FIG. 1, the supply-side common-liquid-chamber 10 is communicated with supply ports 71, and the drainage-side common-liquid-chamber 50 is communicated with the drainage ports 81.

Note that, in the present embodiment, the common-liquid-chamber substrate 20 includes a first common-liquid-chamber substrate 21 and a second common-liquid-chamber substrate 22. The first common-liquid-chamber substrate 21 is bonded to the diaphragm member 3 side of the channel member 40. The second common-liquid-chamber substrate 22 is laminated on and bonded to the first common-liquid-chamber substrate 21.

The first common-liquid-chamber substrate 21 includes a downstream-side common-liquid-chamber 10A and the drainage-side common-liquid-chamber 50. The downstream-side common-liquid-chamber 10A is part of the supply-side common-liquid-chamber 10 communicated with the liquid introduction portion 8. The drainage-side common-liquid-chamber 50 is communicated with a drainage channel 51. The second common-liquid-chamber substrate 22 includes an upstream-side common-liquid-chamber 10B that is a remaining portion of the supply-side common-liquid-chamber 10.

The downstream-side common-liquid-chamber 10A constitutes part of the supply-side common-liquid-chamber 10. The downstream-side common-liquid-chamber 10A and the drainage-side common-liquid-chamber 50 are arranged side by side in the direction perpendicular to the nozzle array direction NAD (the longitudinal direction of individual-liquid-chamber 6). In FIG. 2, the drainage-side common-liquid-chamber 50 is disposed at the same height (layer) as the downstream-side common-liquid-chamber 10A.

The channel substrate 2 includes the drainage channels 51 formed along a surface direction of the channel substrate 2 and communicated with the individual-liquid-chambers 6 via the nozzle communication channel 5. The drainage channels 51 are communicated with the drainage-side common-liquid-chamber 50. Thus, the liquid is drained from the drainage channels 51 to the drainage-side common-liquid-chamber 50.

In the liquid discharge head 404 thus configured, for example, when a voltage lower than a reference voltage is applied to the piezoelectric element 12A, the piezoelectric element 12A contracts. Accordingly, the vibration portion 30 of the diaphragm member 3 is pulled away from the nozzle 4 to expand the volume of the individual-liquid-chamber 6, thus causing liquid to flow into the individual-liquid-chamber 6.

When the voltage applied to the piezoelectric element 12A is raised above the reference voltage, the piezoelectric element 12A extends. Accordingly, the vibration portion 30 of the diaphragm member 3 deforms in a direction toward the nozzle 4 and the volume of the individual-liquid-chamber 6 contracts. Thus, liquid in the individual-liquid-chamber 6 is compressed and discharged from the nozzles 4.

Liquid not discharged from the nozzles 4 passes the nozzles 4, is drained from the drainage channels 51 to the drainage-side common-liquid-chamber 50 and supplied from the drainage-side common-liquid-chamber 50 to the supply-side common-liquid-chamber 10 again through an external circulation route.

Note that the driving method of the liquid discharge head 404 is not limited to the above-described example (i.e., pull-push discharge). For example, pull discharge or push discharge may be performed in response to the way to apply the drive waveform.

Figure 4:
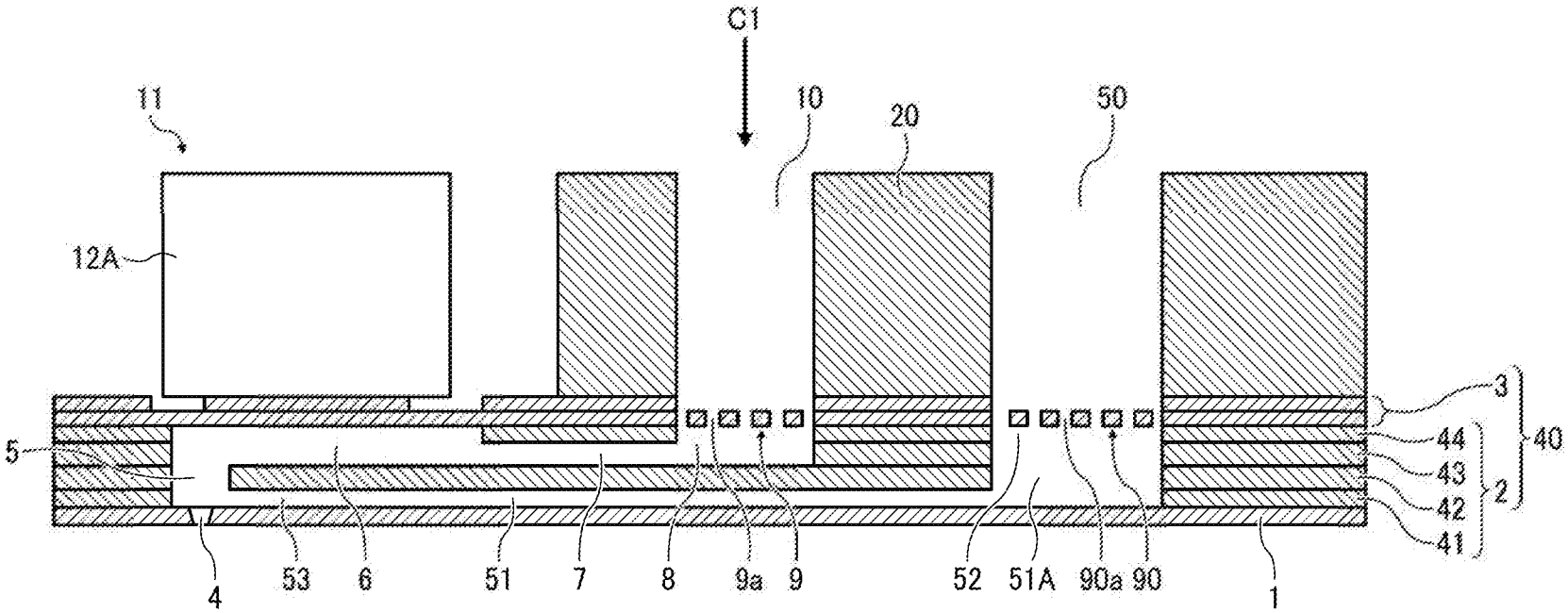
FIG. 4 is a cross-sectional view of the main portion of the liquid discharge head in a cross section A1-A1 of FIG. 5 cut in the direction perpendicular to the nozzle array direction (a longitudinal direction of an individual-liquid-chamber)
Figure 5:
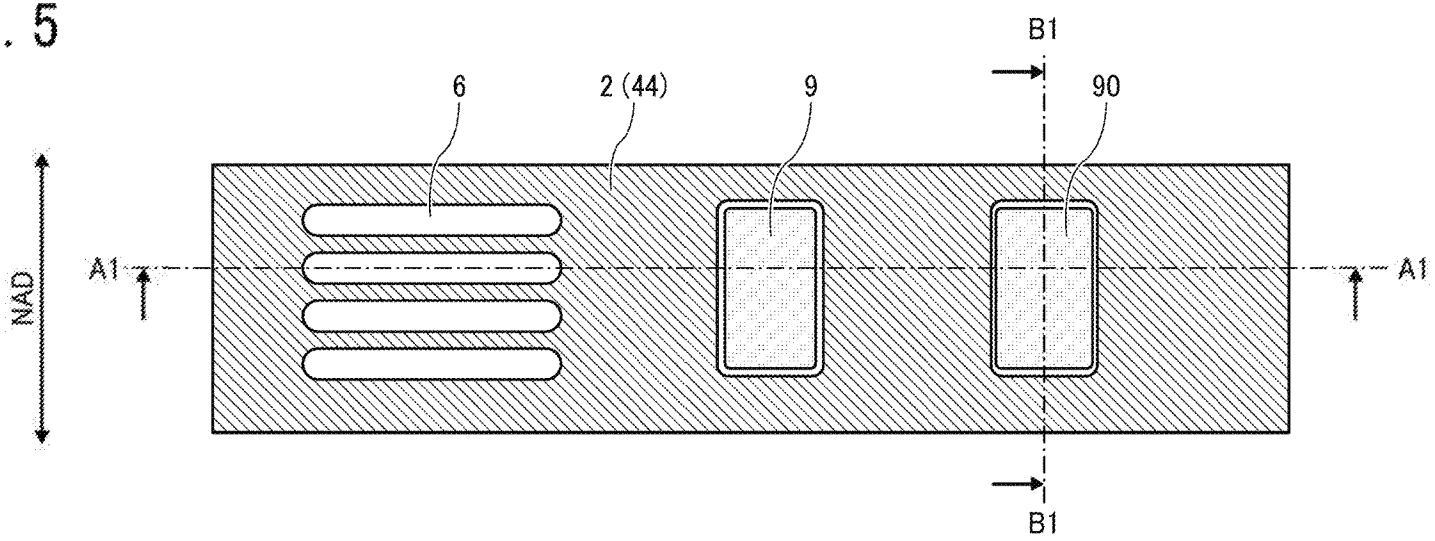
FIG. 5 is a plan view of the liquid discharge head, seen from a direction indicated by arrow C1 in FIG. 4.
Figure 6:
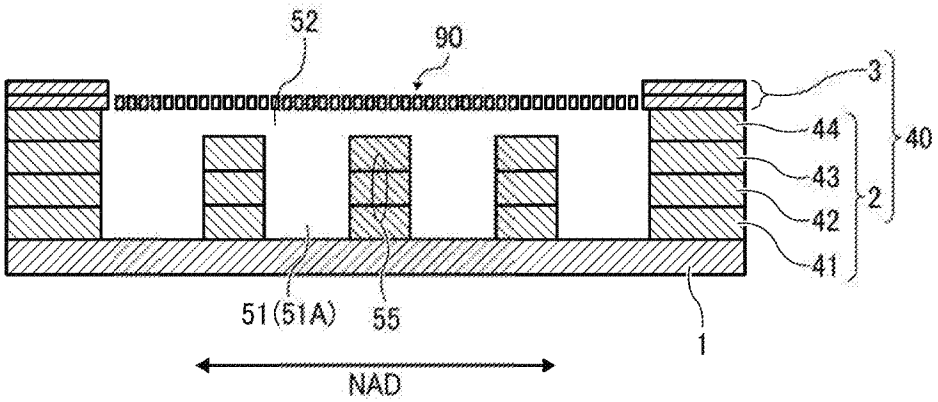
FIG. 6 is a cross-sectional view of the main portion of the liquid discharge head in a cross section B1-B1 of FIG. 5 cut in the nozzle array direction.

FIGS. 4 to 7E illustrate the liquid discharge head 404 according to a first embodiment of the present disclosure. FIG. 4 is a cross-sectional view of a main portion of the liquid discharge head 404 in a cross section A1-A1 of FIG. 5 cut in the direction perpendicular to the nozzle array direction NAD (the longitudinal direction of individual-liquid-chamber 6). FIG. 5 is a plan view of the main portion of the liquid discharge head 404 seen from the direction indicated by an arrow C1 in FIG. 4. FIG. 6 is a cross-sectional view of the main portion of the liquid discharge head 404 in a cross section B1-B1 of FIG. 5 cut in the nozzle array direction NAD. FIGS. 7A to 7E are exploded plan views of a channel substrate 2 and the diaphragm member 3.

In the present embodiment, the channel substrate 2 includes the drainage channels 51 formed at the nozzle plate 1 side of the channel substrate 2 that is opposite side of the channel substrate 2 where the individual-liquid-chambers 6 is formed. In FIG. 4, the drainage channels 51 is formed between the nozzle plate 1 and the plate member 42 so that the liquid flowing through the drainage channels 51 flow along the nozzle plate 1. The drainage channels 51 communicate with the individual-liquid-chambers 6 via the nozzle communication channel 5.

Drainage-side fluid restrictors 53 are provided at the nozzle communication channel 5 side of the drainage channels 51 (left-hand side in FIG. 4). The channel substrate 2 includes a penetration portion 51A that penetrates the channel substrate 2. The penetration portion is disposed at the opposite side of the drainage-side fluid restrictors 53 in the drainage channel 51 (right-hand side in FIG. 4). A common-drainage-channel 52 is formed at a portion of the penetration portion 51A where the penetration portion 51A faces the diaphragm member 3 (upper portion of the penetration portion 51A in FIGS. 4 and 6). The common-drainage-channel 52 interchangeably communicates with two or more drainage channels 51 adjoining in the nozzle array direction NAD as illustrated in FIG. 6.

As illustrated in FIG. 6, partitions 55 are formed between the penetration portions 51A and 51A but do not connect with the diaphragm member 3. In other words, there is a space provided between a drainage-side filter 90 and the top of each of the partitions 55 in FIG. 6. This space forms the common-drainage-channel 52. The common-drainage channel 52 faces and communicates with the drainage-side common-liquid-chamber 50 as illustrated in FIG. 4.

As illustrated in FIGS. 2 and 4, a supply-side filter 9 is disposed between the supply-side common-liquid-chamber 10 (downstream-side common-liquid-chamber 10A) and the liquid introduction portions 8 (individual-liquid-chamber 6). The supply-side filter 9 filters foreign substance from liquid flowing through the supply-side filter 9. The supply-side filter 9 may be disposed between the upstream-side common-liquid-chamber 10B and the downstream-side common-liquid-chamber 10A, for example, if the supply-side filter 9 is disposed upstream from the individual-liquid-chamber 6 in a liquid flow direction in which the liquid flows through the liquid discharge head 404.

A drainage-side filter 90 is disposed between the drainage-side common-liquid-chamber 50 and the common-drainage-channel 52 of the drainage channel 51. The drainage-side filter 90 filters and does not allow the foreign substance, the size of which is equal to or greater than a predetermined size, to pass through the drainage-side filter 90. The drainage-side filter 90 may be disposed inside the drainage-side common-liquid-chamber 50 if the drainage-side filter 90 is disposed downstream from the drainage channel 51.

The diaphragm member 3 forms one wall of the plurality of individual-liquid-chambers 6, and the supply-side filter 9 and the drainage-side filter 90 is disposed in the diaphragm member 3.

As illustrated in FIG. 5, the supply-side filter 9 has a filter region corresponding to two or more numbers of the individual-liquid-chambers 6. In other words, the supply-side filter 9 has a filter region that communicates with two or more numbers of the individual-liquid-chambers 6. In FIG. 5, the supply-side filter 9 has a filter region that communicates with four individual-liquid-chambers 6.

A number of the individual-liquid-chambers 6 corresponding to the supply-side filter 9 and a number of the drainage channels 51 corresponding to the drainage-side filter 90 may be identical or different. In FIG. 5, the number of the individual-liquid-chambers 6 corresponding to the supply-side filter 9 (four in FIG. 5) and the number of the drainage channels 51 corresponding to the drainage-side filter 90 (four in FIG. 6) is identical.

In the present embodiment, as illustrated in FIG. 6, any one of three partitions 55 that face to the drainage-side filter 90 does not contact with the diaphragm member 3 (drainage-side filter 90). Thereby, the common-drainage-channel 52 is formed between the drainage-side filter 90 and each of upper ends of the three partitions 55. Liquid flows through each of the drainage channels 51 are merged at the common-drainage-channel 52 and collectively passes through the drainage-side filter 90 as one stream. Thus, in the present embodiment, the drainage-side filter 90 corresponds to (communicates with) four drainage channels 51.

Both of the supply-side filter 9 and the drainage-side filter 90 are formed by the diaphragm member 3. That is, the supply-side filter 9 and the drainage-side filter 90 are made of the same material. Thus, the supply-side filter 9 and the drainage-side filter 90 can be formed at the same time, and it is easy to arrange the supply-side filter 9 and the drainage-side filter 90 on the diaphragm member 3.

The supply-side filter 9 has filter holes 9*a* and the drainage-side filter 90 has filter holes 90*a*. Both of the diameter of filter holes 9*a* of the supply-side filter 9 and the diameter of filter holes 90*a* of the drainage-side tilter 90 are smaller than the diameter of the nozzles 4. Thus, the supply-side filter 9 and the drainage-side filter 90 can remove the foreign substance that may be clogged in the nozzles 4.

In this case, the diameter of filter holes 90*a* of the drainage-side filter 90 can be greater than the diameter of filter holes 9*a* of the supply-side filter 9. Thereby, even when the foreign substance that passes through the supply-side filter 9 is not discharged from the nozzles 4, the foreign substance is drained by passing through the drainage-side filter 90. Thus, the present embodiment can prevent the foreign substance to remain inside the liquid discharge head 404.

In the present embodiment, the channel substrate 2 is formed by laminating and bonding a plurality of plate members (thin-layer members) 41 to 44 from the nozzle plate 1 side. These plate members 41 to 44 and the diaphragm member 3 are laminated and bonded to form the channel member 40.

Figure 7A:
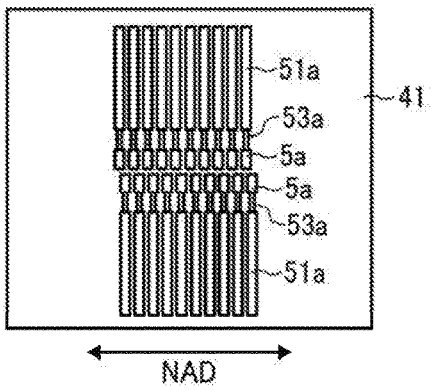
FIGS. 7A to 7E are exploded plan views of a channel substrate and the diaphragm member.

As illustrated in FIG. 7A, the plate member 41 that forms the channel substrate 2 includes slots 5*a* that constitute the nozzle communication channels 5 and slots 51*a* and 53*a* that constitute the drainage channels 51. The slots 5*a*, 53*a*, and 51*a* are groove-shaped through holes. The slots 53*a* are the portions that form the drainage-side fluid restrictors 53

Figure 7B:
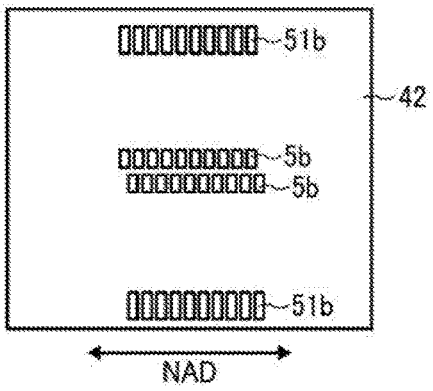

Similarly, as illustrated in FIG. 7B, the plate member 42 includes slots 5*b* that constitute the nozzle communication channels 5 and slots 51*b* that constitute the drainage channels 51.

Figure 7C:
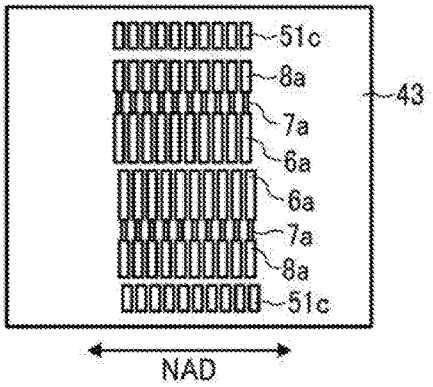

Similarly, as illustrated in FIG. 7C, the plate member 43 includes slots 6*a* that constitute the individual-liquid-chambers 6, slots 7*a* that constitute the supply-side fluid restrictors 7, slots 8*a* that constitute the liquid introduction portion 8, and slots 51*c* that constitute the drainage channels 51.

Figure 7D:
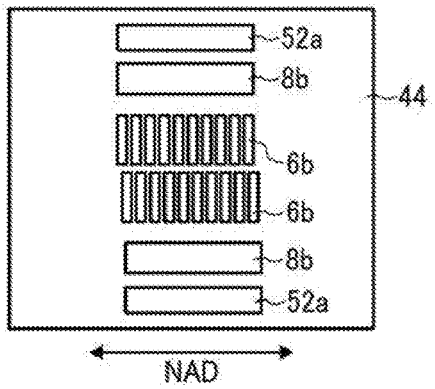

Similarly, as illustrated in FIG. 7D, the plate member 44 includes slots 6*b* that constitute the individual-liquid-chambers 6, slots 8*b* that constitute the liquid introduction portion 8, and slots 52*a* that constitute the common-drainage-channel 52. The longitudinal direction of the slots 8*b* and the slots 52*a* are along the nozzle array direction NAD.

Figure 7E:
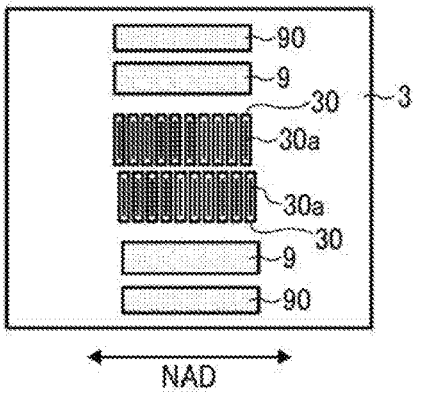

Similarly, as illustrated in FIG. 7E, the diaphragm member 3 includes the vibration portions 30, the supply-side filters 9, and the drainage-side filters 90.

In this way, in the present embodiment, the supply-side filter 9 is disposed between the supply-side common-liquid-chamber 10 and the liquid introduction portions 8 (individual-liquid-chamber 6), and the drainage-side filter 90 is disposed between the drainage channel 51 (common-drainage-channel 52) and the drainage-side common-liquid-chamber 50.

Thereby, the supply-side filter 9 can trap the foreign substance that is mixed into the liquid supplied from the supply-side common-liquid-chamber 10 to the individual-liquid-chamber 6. Further, the present embodiment can prevent the foreign substance to enter into the drainage channel 51 from the drainage-side common-liquid-chamber 50 when assembling the liquid discharge head 404. Therefore, the present embodiment can prevent the foreign substance to be mixed into the liquid discharge head 404.

Liquid flows from the drainage channel 51 to the drainage-side common-liquid-chamber 50. Thus, it is not necessary to provide the filter between the drainage channel 51 and the drainage-side common-liquid-chamber 50 for the purpose of removing the foreign substance in liquid. However, in the present embodiment, the drainage-side filter 90 is provided for preventing the foreign substance entering into the drainage channel 51 from the drainage-side common-liquid-chamber 50 when assembling the liquid discharge head 404, for example.

By providing the drainage-side filter 90 between the common-drainage-channel 52 of the drainage channel 51 and the drainage-side common-liquid-common chamber 50, it is possible to prevent foreign substance to enter into the drainage channel 51 from the drainage-side common-liquid-chamber 50 when liquid flow backward from the drainage-side common-liquid-chamber 50 to the drainage channel 51.

In FIGS. 5 and 6, for ease of illustration only one set of four individual-liquid-chambers 6, one supply-side filter 9, four drainage channels 51, and one drainage-side filter 90 is illustrated. However, it is to be understood that the liquid discharge head 404 includes a plurality of the above-described sets arranged in the nozzle array direction.

Figure 8:
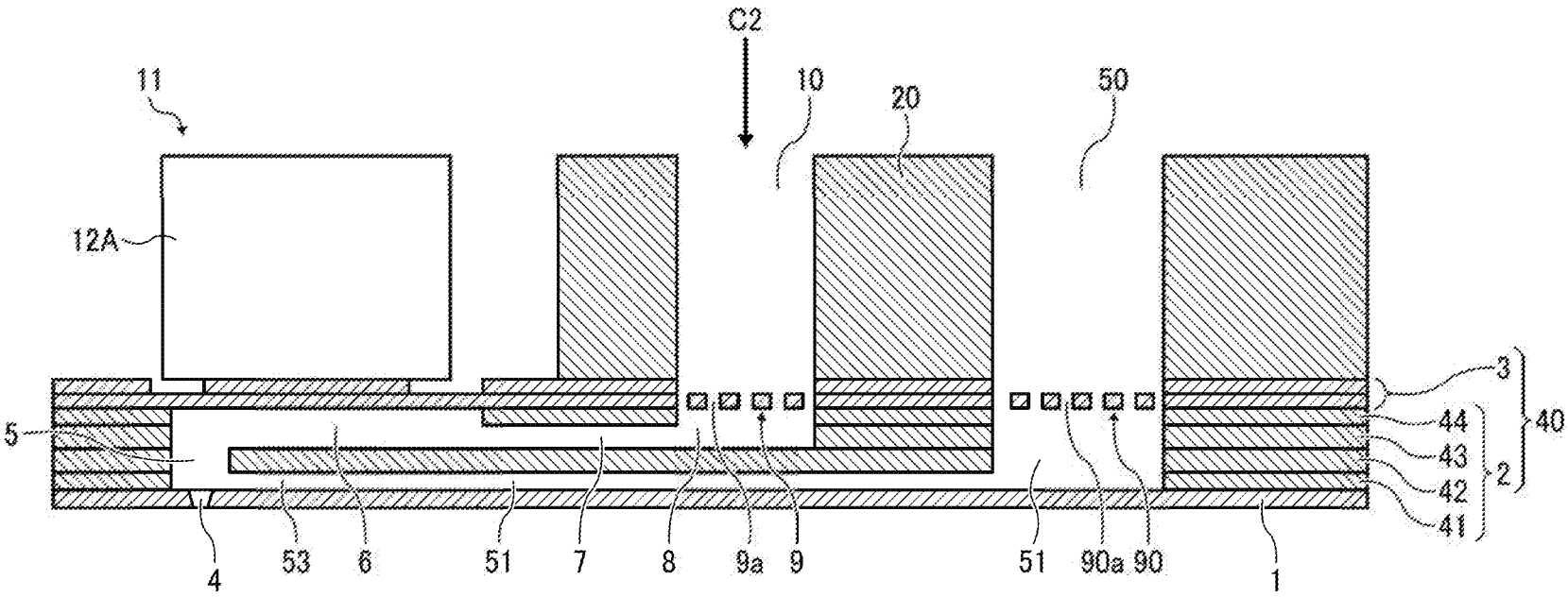
FIG. 8 is a cross-sectional view of the main portion of the liquid discharge head according to a second embodiment of the present disclosure in a cross section A2-A2 of FIG. 9 cut in the direction perpendicular to the nozzle array direction (a longitudinal direction of an individual-liquid-chamber)
Figure 9:
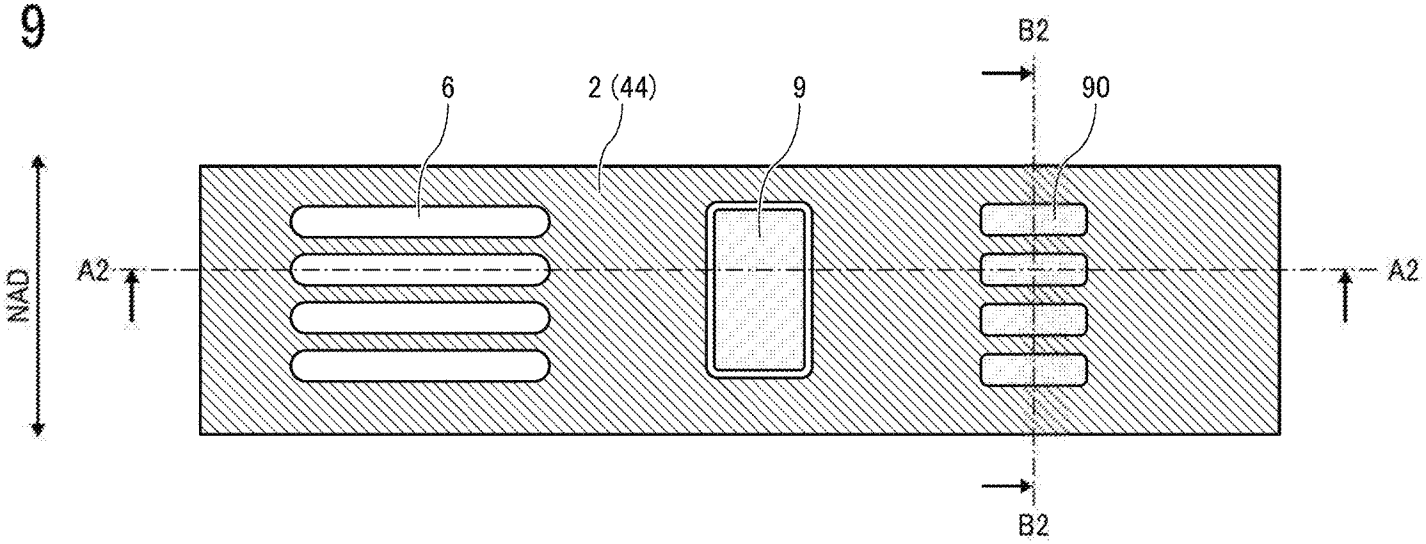
FIG. 9 is a plan view of the liquid discharge head, seen from a direction indicated by arrow C2 in FIG. 8.
Figure 10:
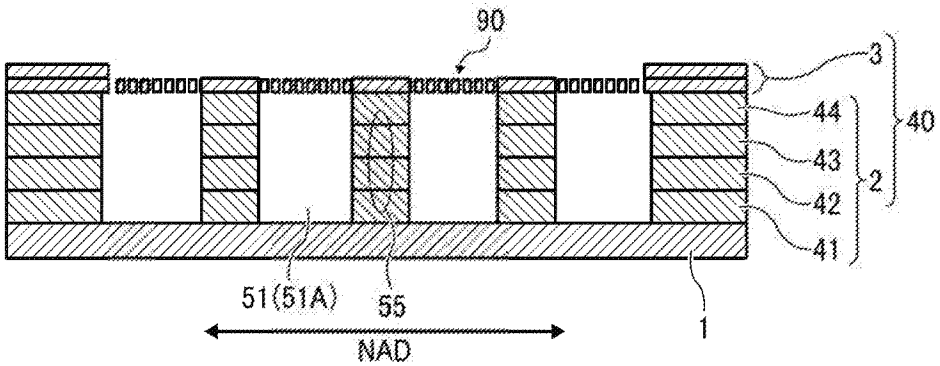
FIG. 10 is a cross-sectional view of the liquid discharge head in a cross section B2-B2 of FIG. 9 cut in the nozzle array direction.

FIGS. 8 to 11E illustrate the liquid discharge head 404 according to a second embodiment of the present disclosure. FIG. 8 is a cross-sectional view of a main portion of the liquid discharge head 404 in a cross section A2-A2 of FIG. 9 cut in the direction perpendicular to the nozzle array direction NAD (the longitudinal direction of individual-liquid-chamber 6). FIG. 9 is a plan view of the main portion of the liquid discharge head 404 seen from the direction indicated by an arrow C2 in FIG. 8. FIG. 10 is a cross-sectional view of the main portion of the liquid discharge head of FIG. 6 in a cross section B2-B2 of FIG. 9 cut in the nozzle array direction NAD. FIGS. 11A to 11E are exploded plan views of a channel substrate 2 and the diaphragm member 3.

In the present embodiment, each of the adjoining drainage channels 51 is independently penetrating through the channel substrate 2. That is, the partitions 55 between the penetration portions 51A and 51A reaches to and contacts the diaphragm member 3 (drainage-side filters 90) so that the common-drainage-channel 52 is not formed between the partitions 55 and the drainage-side filters 90.

As illustrated in FIGS. 8 to 10, the drainage-side filter 90 is provided for each of the drainage channels 51 (See FIGS. 9 and 10) and is disposed between the drainage-side common-liquid-chambers 50 and the drainage channels 51 (See FIG. 8).

Specifically, the liquid discharge head 404 includes a plurality of drainage-side filters 90. The supply-side filter 9 communicates with two or more of the plurality of individual-liquid-chambers 6, and the plurality of drainage-side filters 90 communicate with the plurality of drainage channels 51, respectively For example, the number of the plurality of drainage channels 51 that communicate with one drainage-side filter 90 is one as illustrated in FIGS. 9 and 10. The number of the plurality of individual-liquid-chambers 6 that communicate with one supply-side filter 9 is four as illustrated in FIGS. 9 and 10. Thus, the number of the plurality of drainage channels 51 that communicate with the drainage-side filter 90 (one in FIGS. 9 and 10) is smaller than a number of the plurality of individual-liquid-chambers 6 that communicate with the supply-side filter 9 (four in FIGS. 9 and 10).

Figure 11A:
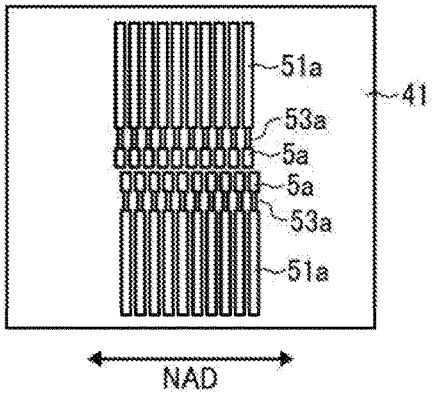
FIGS. 11A to 11E are exploded plan views of a channel substrate and the diaphragm member.
Figure 11B:
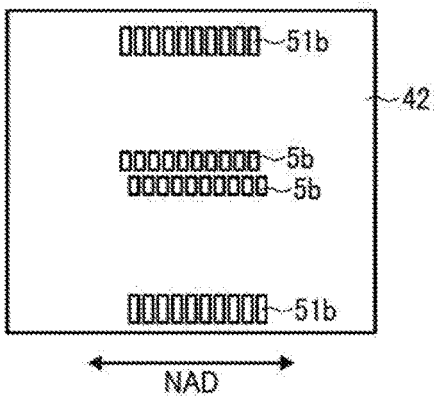
Figure 11C:
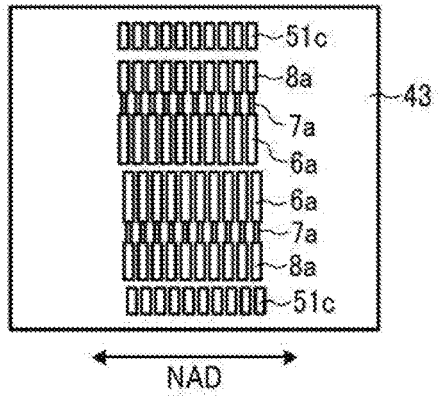
Figure 11D:
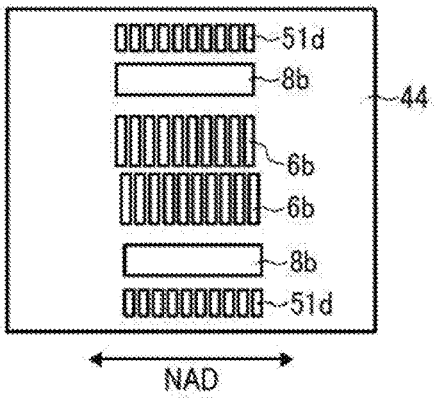
Figure 11E:
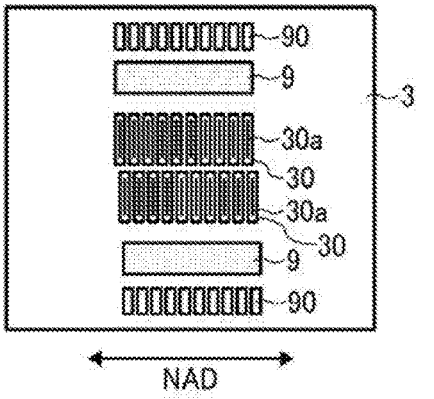

More specifically, as illustrated in FIG. 11D, the plate member 44 that constitutes the channel substrate 2 includes slots 6*b* that constitute the individual-liquid-chambers 6, slots 8*b* that constitute the liquid introduction portion 8, and slots 51*d* that constitute the penetration portions 51A of the drainage channels 51. The longitudinal direction of the slots 8*b* is along the nozzle array direction NAD.

In this way, by providing the drainage-side filter 90 for each drainage channels 51, one drainage channel 51 corresponds to (communicates with) one drainage-side filter 90. Comparing to the configuration in which the drainage-side filter 90 corresponds to two or more drainage channels 51 (that is, when the common-drainage-channel 52 is provided), the present embodiment can prevent sharp increase of the cross-sectional area of the drainage channel 51 and increase the flow speed of liquid that enters into the drainage-side filter 90 from the drainage channel 51.

Thereby, the bubble easily passes through the drainage-side filter 90, and ability to remove the bubble from the liquid discharge head 404 is increased.

Figure 12:
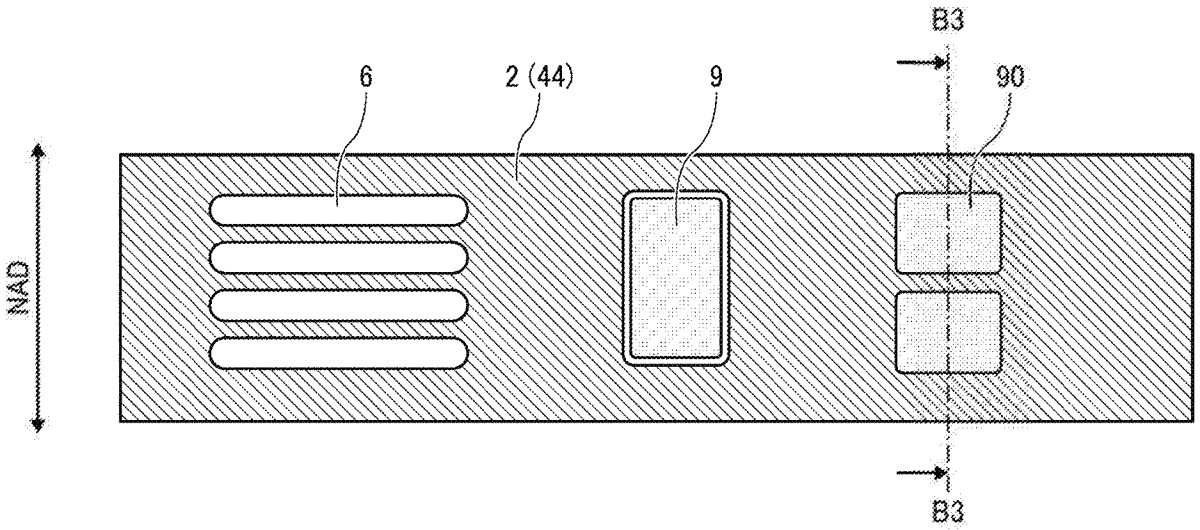
FIG. 12 is a plan view of the liquid discharge head similar to FIG. 5 according to a third embodiment of the present disclosure.
Figure 13:
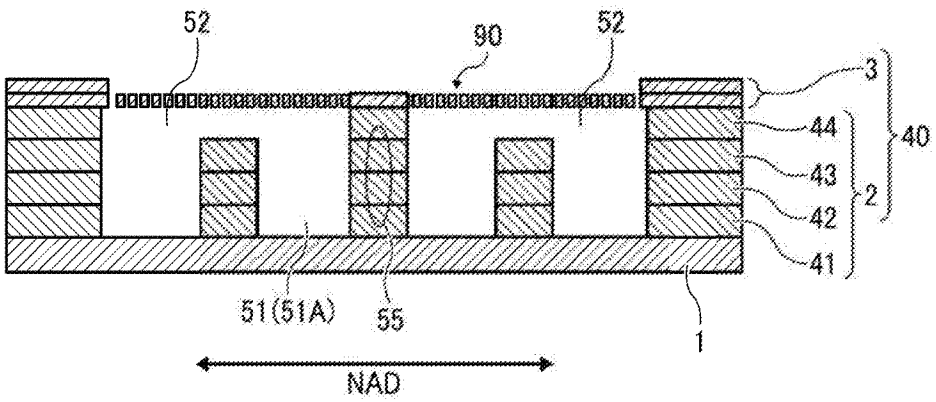
FIG. 13 is a cross-sectional view of the liquid discharge head in a cross section B3-B3 of FIG. 12 cut in the nozzle array direction.

FIGS. 12 to 14E illustrate the liquid discharge head 404 according to a third embodiment of the present disclosure. FIG. 12 is a plan view of the liquid discharge head 404 similar to FIGS. 5 and 9. FIG. 13 is a cross-sectional view of the main portion of the liquid discharge head 404 in a cross section B3-B3 of FIG. 12 cut in the nozzle array direction NAD. FIGS. 14A to 14E are exploded plan views of a channel substrate 2 and the diaphragm member 3.

In the present embodiment, the common-drainage-channel 52 as described in the first embodiment is provided for every adjoining two drainage channels 51. As illustrated in FIG. 13, a partition 55 is provided between two of the penetration portions 51A and 51A of the drainage channels 51. The partition 55 reaches to and contacts the diaphragm member 3 (drainage-side filter 90). The partition 55 is provided for every two drainage channels 52.

The drainage-side filter 90 is disposed between the drainage-side common-liquid-chambers 50 and the common-drainage-channel 52. Further, the drainage-side filter 90 is provided for every two adjoining drainage channels 51.

Thus, the supply-side filter 9 communicates with two or more of the plurality of individual-liquid-chambers 6, and fewer drainage channels 51 communicate with the drainage-side filter 90 than individual-liquid-chambers 6 communicate with the supply-side filter 9.

For example, the number of the plurality of drainage channels 51 that communicate with one drainage-side filter 90 is two as illustrated in FIGS. 12 and 13. The number of the plurality of individual-liquid-chambers 6 that communicate with one supply-side filter 9 is four as illustrated in FIGS. 12 and 13. Thus, the number of the plurality of drainage channels 51 that communicate with the drainage-side filter 90 (two in FIGS. 12 and 13) is smaller than a number of the plurality of individual-liquid-chambers 6 that communicate with the supply-side filter 9 (four in FIGS. 12 and 13).

Figure 14A:
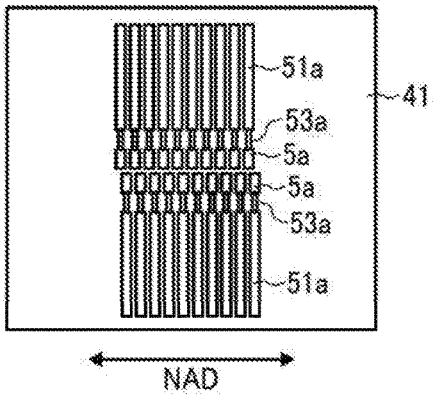
FIGS. 14A to 14E are exploded plan views of a channel substrate and the diaphragm member.
Figure 14B:
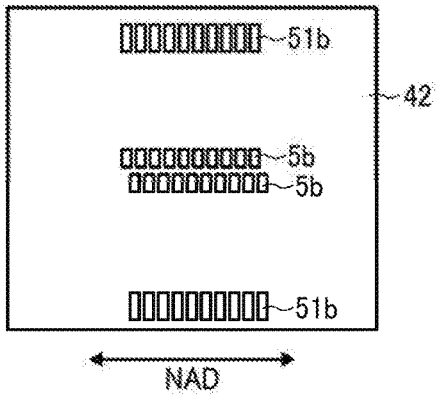
Figure 14C:
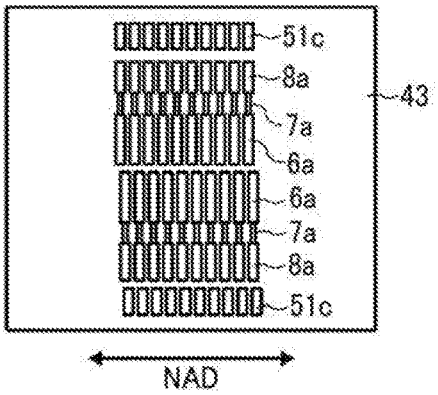
Figure 14D:
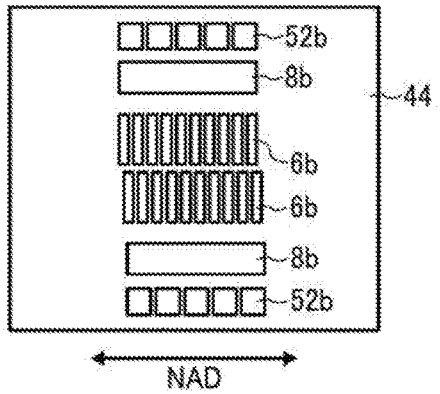
Figure 14E:
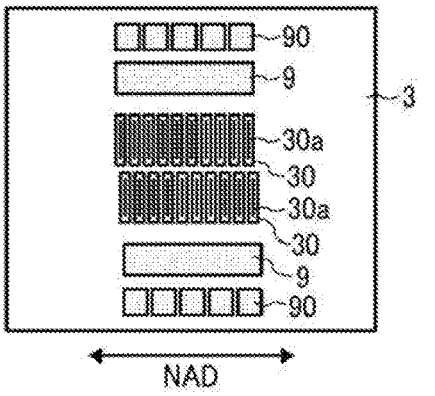

Specifically, as illustrated in FIG. 14D, the plate member 44 that constitutes the channel substrate 2 includes slots 6*b* that constitute the individual-liquid-chambers 6, slots 8*b* that constitute the liquid introduction portion 8, and slots 52*b* that constitute the common-drainage-channel 52. The longitudinal direction of the slots 8*b* is along the nozzle array direction NAD. The common-drainage-channel 52 is provided across two adjoining drainage channels 51.

Comparing to the configuration in which one drainage-side filter 90 corresponds to (communicates with) every drainage channels 51 as illustrated in FIGS. 5 and 6, the present embodiment can increase the flow speed of liquid that enters into the drainage-side filter 90 from the drainage channel 51 by providing the drainage-side filter 90 for every predetermined numbers (two or more) of adjoining drainage channels 51.

Thereby, the bubble easily passes through the drainage-side filter 90, and the ability to remove the bubble from the liquid discharge head 404 in the third embodiment is better than that of the first embodiment.

Figure 15:
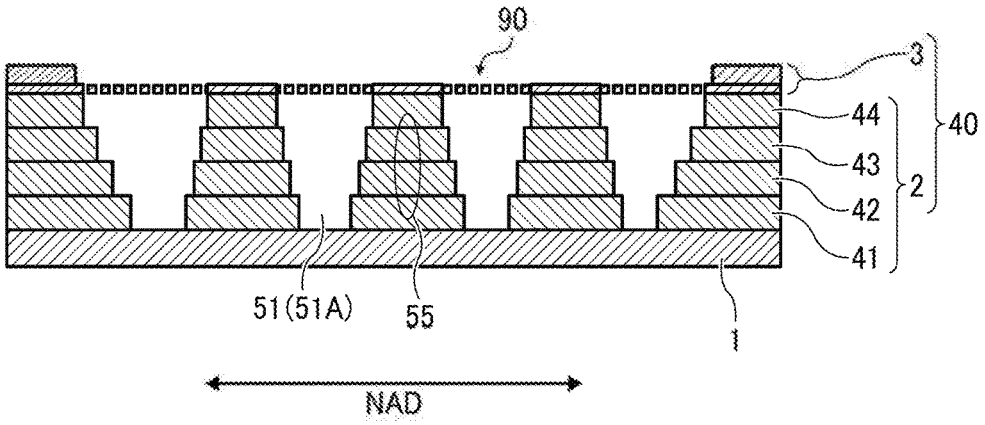
FIG. 15 is a cross-sectional view of the liquid discharge head similar to FIG. 6 according to a fourth embodiment of the present disclosure in the nozzle array direction.

FIG. 15 illustrates the liquid discharge head 404 according to a fourth embodiment of the present disclosure. FIG. 15 is a cross-sectional view of the liquid discharge head 404 along the nozzle array direction NAD as similar to FIGS. 6, 10, and 13.

In the present embodiment, the penetration portions 51A of the drainage channels 51 have a shape that the widths of the penetration portions in the nozzle array direction NAD enlarges toward the drainage-side common-liquid-chamber 50 (the drainage-side filter 90).

Specifically, the plate members 41 to 44 that constitute the channel substrate 2 includes slots 51*a* to 51*d*, and the widths of slots 51*a* to 51*d* in the nozzle array direction NAD is gradually enlarged toward the drainage-side filter 90.

Thus, the penetration portions 51A of the plurality of drainage channels 51 that face the drainage-side filter 90 have shapes in which widths of the penetration portions 51A enlarge toward the drainage-side filter 90 (the drainage-side common-liquid-chamber 50).

The channel substrate 2 is formed by laminating a plurality of plate members 41 to 44. Edged portion may be formed on a wall surface of the partition 55 by misalignment of bonding position of the plate members 41 to 44 if the width of each slots 51*a* to 51*d* is identical. The bubble may be generated and trapped at this edged portion because the liquid flow stagnates (is caught) at the edged portion.

Therefore, the penetration portions 51A of the drainage channels 51 have a shape that the width of the penetration portions in the nozzle array direction NAD enlarges toward the drainage-side common-liquid-chamber 50 (drainage-side filter 90). Thereby, even when the misalignment of bonding position of the plate members 41 to 44 occurs, the edged portion on the wall surface of the partitions is not formed. Thus, the present embodiment can smoothly drain and remove the bubble in the liquid discharge head 404.

Comparing to the configuration in which the common-drainage-channel 52 is provided, the present embodiment can prevent sharp increase of the cross-sectional area of the drainage channel 51 and prevent reduction of the flow speed of the liquid that flows through the drainage channel 51.

In the above described embodiment, the supply-side filter 9 is disposed upstream from the plurality of nozzles 4 in a liquid flow direction in which the liquid flows through the liquid discharge head 404, and the drainage-side filter 90 is disposed downstream from the plurality of the nozzle 4, in the liquid flow direction.

For example, the supply-side filter 9 is disposed between the supply-side common-liquid-chamber 10 and the plurality of individual-liquid-chambers 6, and the drainage-side filter 90 is disposed between the drainage-side common-liquid-chamber 50 and the plurality of drainage channels 51.

However, the present embodiment is not limited to the configuration described above. For example, the supply-side filter 9 may be disposed inside the supply-side common-liquid-chamber 10, and the drainage-side filter 90 may be disposed inside the drainage-side common-liquid-chamber 50.

Further, instead of providing the supply-side filter 9 between the supply-side common-liquid-chamber 10 and the plurality of individual-liquid-chambers 6 and providing the drainage-side filter 90 between the drainage-side common-liquid-chamber 50 and the plurality of drainage channels 51, the supply-side filter 9 may be disposed between the plurality of nozzles 4 and the supply-side common-liquid-chamber 10, and the drainage-side filter 90 may be disposed between the plurality of nozzles 4 and the drainage-side common-liquid-chamber 50.

For example, a plurality of the supply-side filter 9 may be disposed inside the plurality of individual-liquid-chambers 6, respectively, and a plurality of the drainage-side filter 90 may be disposed inside the plurality of drainage channels 51, respectively.

Further, the supply-side filter 9 may be disposed between the plurality of nozzles 4 and plurality of individual-liquid-chambers 6, respectively, and the drainage-side filter 90 may be disposed between the plurality of nozzles 4 and the plurality of drainage channels 51, respectively.

Figure 16:
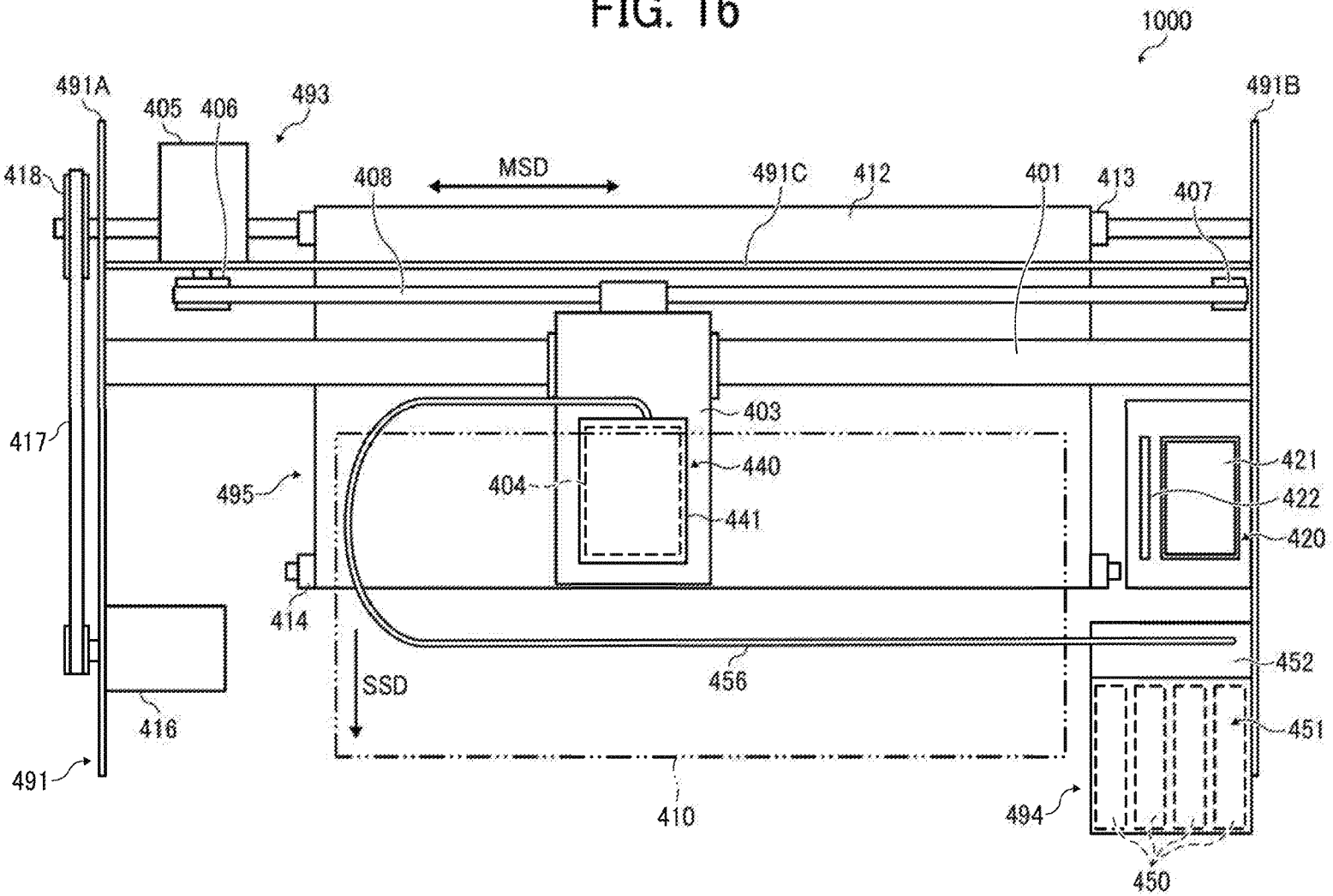
FIG. 16 is a plan view of a portion of a liquid discharge apparatus according to an embodiment of the present disclosure.
Figure 17:
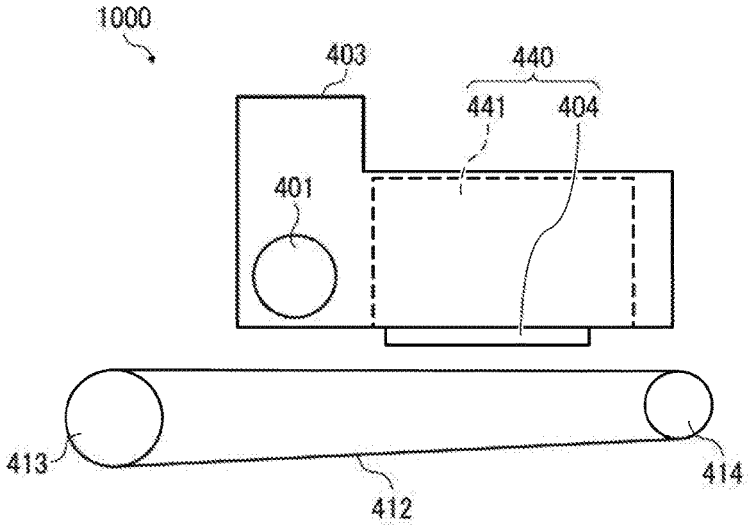
FIG. 17 is a side view of a portion of the liquid discharge apparatus of FIG. 16.

FIGS. 16 and 17 illustrate a liquid discharge apparatus 1000 according to an embodiment of the present disclosure.

FIG. 16 is a plan view of a portion of the liquid discharge apparatus 1000.

FIG. 17 is a side view of a portion of the liquid discharge apparatus 1000 of FIG. 16.

The liquid discharge apparatus 1000 according to the present embodiment is a serial-type apparatus in which a main scan moving unit 493 reciprocally moves a carriage 403 in a main scanning direction indicated by arrow MSD in FIG. 23. The main scan moving unit 493 includes, e.g., a guide 401, a main scanning motor 405, and a timing belt 408. The guide 401 is laterally bridged between a left side plate 491A and a right side plate 491B. The guide 401 supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 according to an embodiment of the present disclosure and a head tank 441 are integrated as a single unit. The liquid discharge head 404 of the liquid discharge device 440 discharges ink droplets of respective colors of yellow (Y), cyan (C), magenta (M), and black (K).

Figure 18:
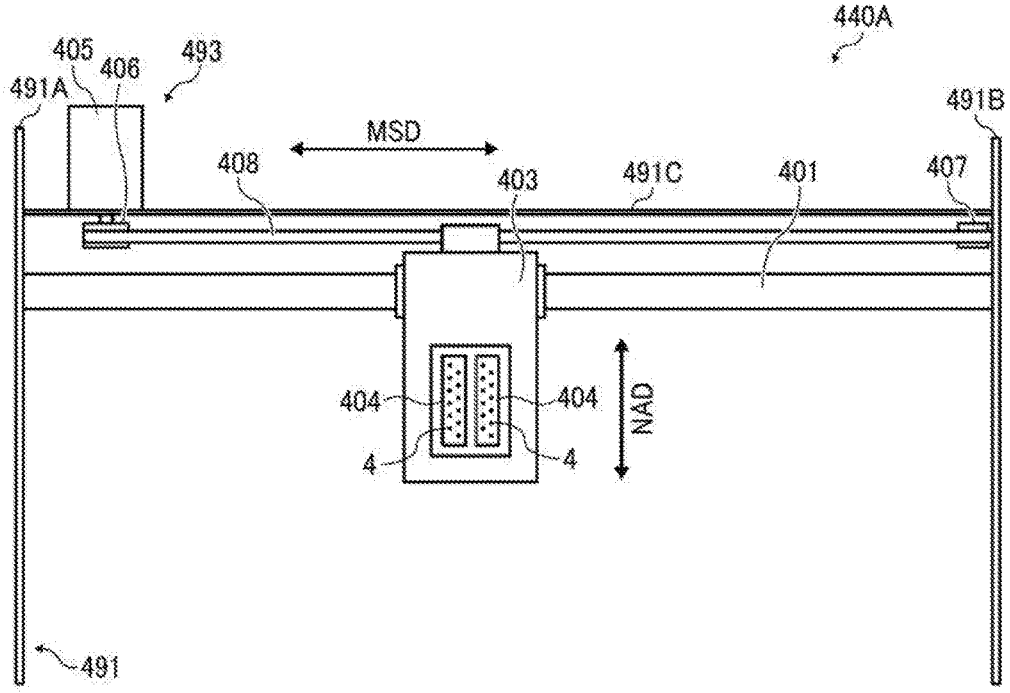
FIG. 18 is a plan view of a portion of a liquid discharge device.

As illustrated in FIG. 18, the liquid discharge head 404 includes nozzle rows, each including a plurality of nozzles 4 arrayed in row in a sub-scanning direction, which is indicated by arrow SSD in FIG. 16, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 1000 includes a conveyance unit 495 to convey a sheet 410. The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the liquid discharge head 404. The conveyance belt 412 is an endless belt and stretched between a conveyance roller 413 and a tension roller 414. The sheet 410 is attracted to the conveyance belt 412 by electrostatic force or air suction.

The conveyance roller 413 is rotated by a sub-scanning motor 416 via a timing belt 417 and a timing pulley 418, so that the conveyance belt 412 circulates in a sub-scanning direction indicated by arrow SSD in FIG. 16.

At one side in the main scanning direction MSD of the carriage 403, a maintenance device 420 to maintain and recover the liquid discharge head 404 in good condition is disposed on a lateral side of the conveyance belt 412.

The maintenance device 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance device 420, and the conveyance unit 495 are mounted to a housing 491 that includes the left side plate 491A, the right side plate 491B, and a rear side plate 491C.

In the liquid discharge apparatus 1000 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 1000 includes the liquid discharge head 404 according to an embodiment of the present disclosure, thus allowing stable formation of high quality images.

FIG. 18 illustrates another example of the liquid discharge device according to an embodiment of the present disclosure.

FIG. 18 is a plan view of a portion of the liquid discharge device 440A.

The liquid discharge device 440A includes the housing 491, the main scan moving unit 493, the carriage 403, and the liquid discharge head 404 among components of the liquid discharge apparatus 1000. The left side plate 491A, the right side plate 491B, and the rear side plate 491C constitute the housing 491.

Note that, in the liquid discharge device 440A, at least one of the maintenance device 420 and the supply unit 494 described above may be mounted on, for example, the right side plate 491B.

Figure 19:
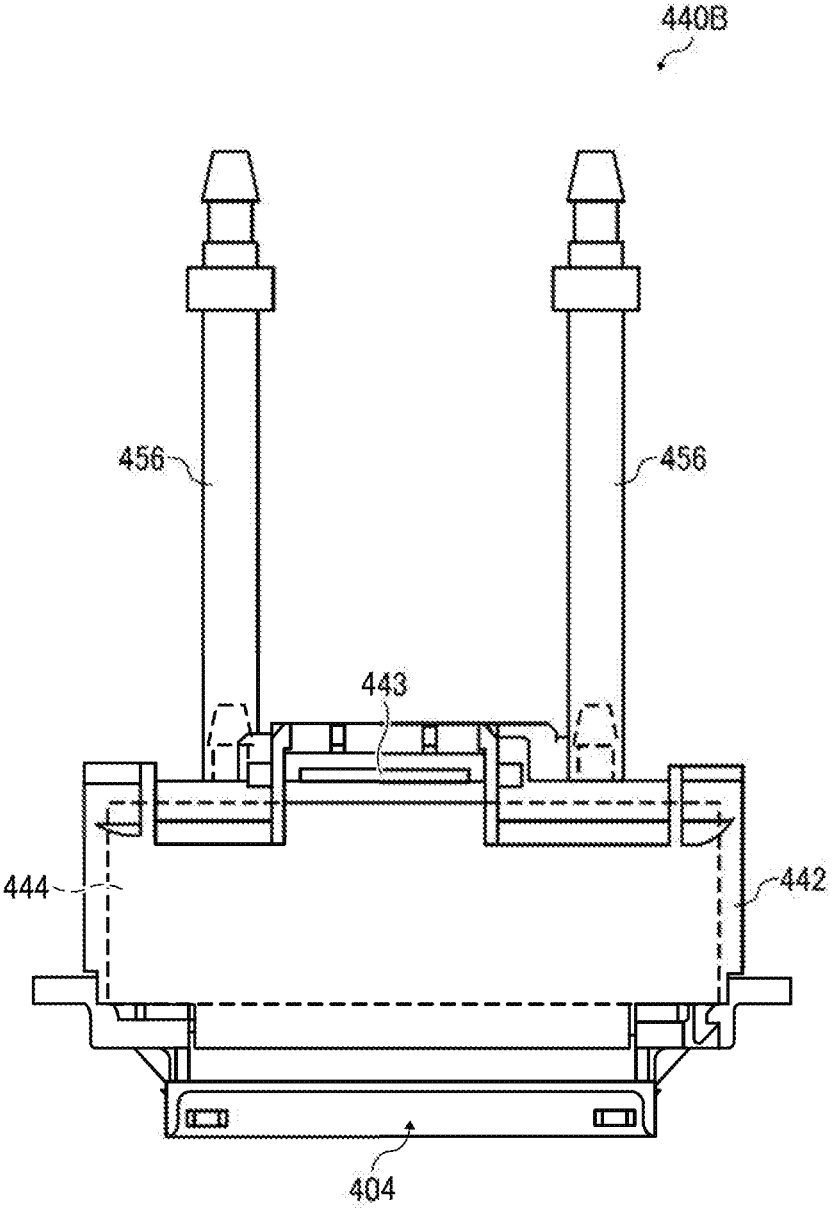
FIG. 19 is a front view of another example of the liquid discharge device.

FIG. 19 illustrates still another example of the liquid discharge device according to an embodiment of the present disclosure.

FIG. 19 is a front view of still another example of the liquid discharge device 440B.

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 20:
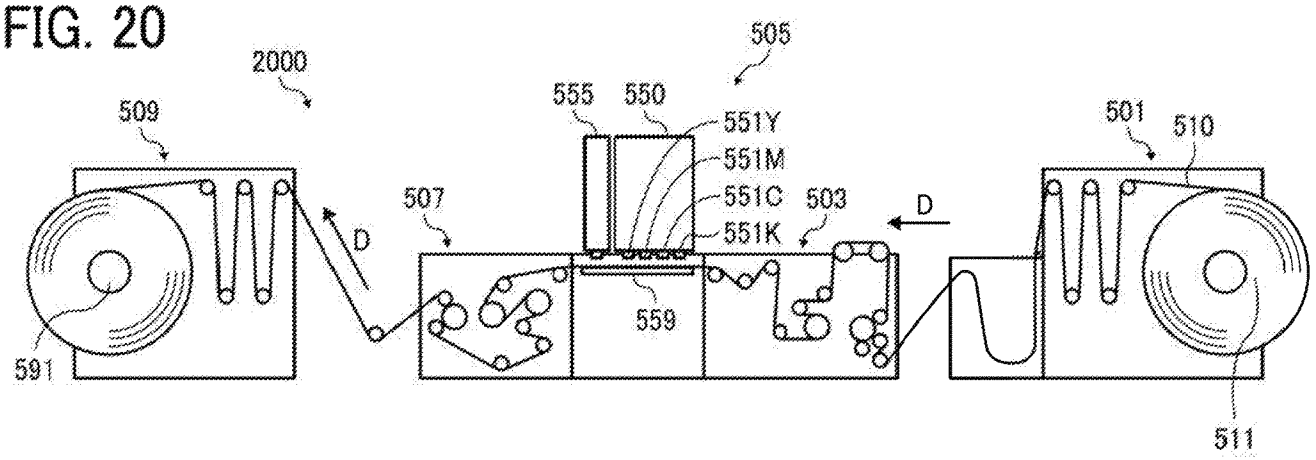
FIG. 20 is a schematic side view of the liquid discharge apparatus according to another embodiment of the present disclosure.
Figure 21:
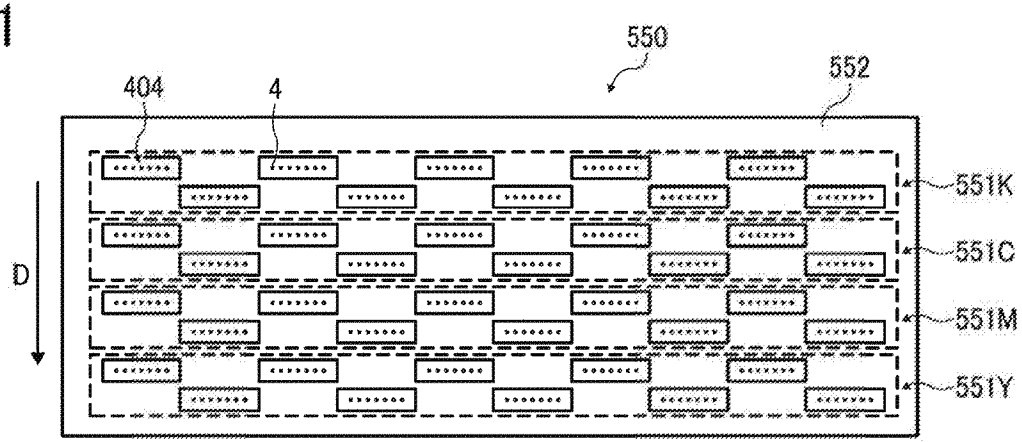
FIG. 21 is a plan view of a head unit of the liquid discharge apparatus of FIG. 20.

FIGS. 20 and 21 illustrate a liquid discharge apparatus 2000 according to another embodiment of the present disclosure.

FIG. 20 is a schematic view of the liquid discharge apparatus 2000.

FIG. 21 is a plan view of a head unit of the liquid discharge apparatus 2000 of FIG. 20.

The liquid discharge apparatus 2000 according to the present embodiment includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the continuous medium 510 (hereinafter, "medium feed direction") indicated by arrow D in FIG. 20.

The head arrays 551K, 551C, 551M, and 551Y are liquid dischargers to discharge liquid of black (K), cyan (C), magenta (M), and yellow (Y) onto the continuous medium 510. Note that the number and types of color are not limited to the above-described four colors of K, C, M, and Y and may be any other suitable number and types.

In each head array 551, for example, as illustrated in FIG. 21, a plurality of liquid discharge heads (also referred to as simply "heads") 404 are arranged in a staggered manner on a base 552 to form the head array 551. Note that the configuration of the head array 551 is not limited to such a configuration.

Figure 22:
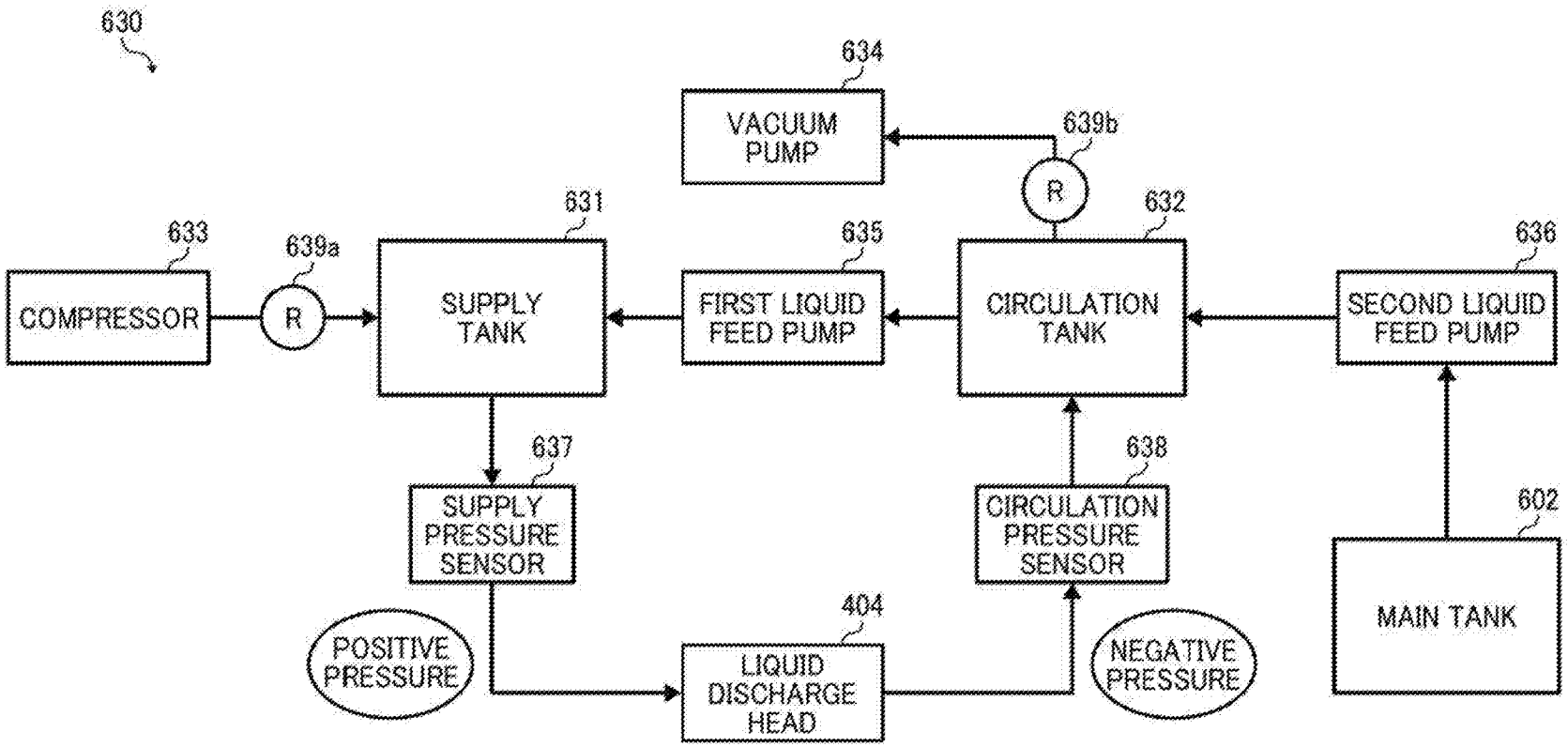
FIG. 22 is a block diagram of a liquid circulation system of the liquid discharge apparatus of FIG. 20.

FIG. 22 illustrates an example of a liquid circulation system according to an embodiment of the present disclosure.

FIG. 22 is a block diagram of the liquid circulation system.

A liquid circulation system 630 includes, e.g., a main tank 602, the liquid discharge head 404, a supply tank 631, a circulation tank 632, a compressor 633, a vacuum pump 634, a first liquid feed pump 635, a second liquid feed pump 636, a supply pressure sensor 637, a circulation pressure sensor 638, a regulator (R) 639*a*, and a regulator (R) 639*b*.

The supply pressure sensor 637 is disposed between the supply tank 631 and the liquid discharge head 404 and connected to a supply channel connected to the supply ports 71 (see FIG. 1) of the liquid discharge head 404. The circulation pressure sensor 638 is disposed between the circulation tank 632 and the liquid discharge head 404 and connected to a drainage channel connected to the drainage ports 81 (see FIG. 1) of the liquid discharge head 404.

One end of the circulation tank 632 is connected to the supply tank 631 via the first liquid feed pump 635 and the other end of the circulation tank 632 is connected to the main tank 602 via the second liquid feed pump 636.

Thus, liquid flows from the supply tank 631 into the liquid discharge head 404 through the supply ports 71 and drained from the drainage port 81 to the circulation tank 632. Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637. The circulation tank 632 is connected to the vacuum pump 634 and controlled so that a predetermined negative pressure is detected with the circulation pressure sensor 638.

Such a configuration allows the meniscus of ink to be maintained at a constant negative pressure while circulating ink through the inside of the liquid discharge head 404.

When droplets are discharged from the nozzles 4 of the liquid discharge head 404, the amount of liquid in each of the supply tank 631 and the circulation tank 632 decreases. Hence, the second liquid feed pump 636 replenishes liquid from the main tank 602 to the circulation tank 632. The replenishment of liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head (e.g., the liquid discharge head 404) with at least one of a head tank (e.g., the head tank 441), a carriage (e.g., the carriage 403), a supply unit (e.g., the supply unit 494), a maintenance device (e.g., the maintenance device 420), and a main scan moving unit (e.g., the main scan moving unit 493).

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main scan moving unit, so that the liquid discharge head and the main scan moving unit are integrated as a single unit. The liquid discharge device may include the liquid discharge head, the carriage, and the main scan moving unit that are integrated as a single unit.

In another example, the cap that forms part of the maintenance device is secured to the carriage mounting the liquid discharge head so that the liquid discharge head, the carriage, and the maintenance device are integrated as a single unit to form the liquid discharge device.

Further, in another example, the liquid discharge device includes tubes connected to the liquid discharge head mounted on the head tank or the channel member so that the liquid discharge head and the supply assembly are integrated as a single unit. Liquid is supplied from a liquid reservoir source to the liquid discharge head through the tube.

The main scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material, to which liquid can be adhered, or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

In addition, the liquid discharge apparatus is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

"The liquid discharge apparatus" may be an apparatus to relatively move a liquid discharge head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the sheet with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles from which a liquid is discharged, a plurality of individual-liquid-chambers that communicate with the plurality of nozzles, respectively;

a supply-side common-liquid-chamber to supply the liquid to the plurality of individual-liquid-chambers;

a plurality of drainage channels that communicate with the plurality of individual-liquid-chambers, respectively;

a drainage-side common-liquid-chamber to drain the liquid in the plurality of drainage channels;

a supply-side filter disposed upstream from the plurality of nozzles in a liquid flow direction in which the liquid flows through the liquid discharge head;

a drainage-side filter disposed downstream from the plurality of nozzles in the liquid flow direction; and a plurality of partitions located upstream in the liquid flow direction of the drainage-side filter to define the plurality of drainage channels, wherein a first partition of the plurality of partitions is opposite filter holes of the drainage-side filter.

2. The liquid discharge head according to claim 1, wherein the supply-side filter is disposed between the supply-side common-liquid-chamber and the plurality of individual-liquid-chambers, and wherein the drainage-side filter is disposed between the drainage-side common-liquid-chamber and the plurality of drainage channels.

3. The liquid discharge head according to claim 1, wherein a single member forms the supply-side filter and the drainage-side filter.

4. The liquid discharge head according to claim 1, further comprising a diaphragm that forms a part of a wall surface of the plurality of individual-liquid-chambers, the supply-side filter and the drainage-side filter disposed in the diaphragm.

5. The liquid discharge head according to claim 1, wherein each of the drainage-side filter and the supply-side filter includes the filter holes; and a diameter of the filter holes of the drainage-side filter is greater than a diameter of the filter holes of the supply-side filter.

6. The liquid discharge head according to claim 1, wherein the supply-side filter communicates with two or more of the plurality of individual-liquid-chambers, and wherein a number of the plurality of drainage channels that communicate with the drainage-side filter is smaller than a number of the plurality of individual-liquid-chambers that communicate with the supply-side filter.

7. The liquid discharge head according to claim 1, further comprising a plurality of drainage-side filters, wherein the supply-side filter communicates with two or more of the plurality of individual-liquid-chambers, and the plurality of drainage-side filters communicate with the plurality of drainage channels, respectively.

8. The liquid discharge head according to claim 1, wherein portions of the plurality of drainage channels that face the drainage-side filter have shapes in which widths of the portions enlarge toward the drainage-side filter.

9. A liquid discharge device, comprising the liquid discharge head as claimed in claim 1.

10. The liquid discharge head according to claim 1, wherein the drainage-side filter includes a plurality of filter regions spaced apart from one another by a second partition which is taller than the first partition.

11. The liquid discharge head according to claim 1, wherein the first partition is spaced apart from the drainage-side filter so as to define a common-drainage-channel, and the liquid in the plurality of drainage channels merge at the common-drainage-channel and collectively passes through the drainage-side filter.

12. The liquid discharge device according to claim 9, further comprising at least one member of:

a head tank to store liquid to be supplied to the liquid discharge head;

a carriage to mount the liquid discharge head;

a maintenance device to maintain the liquid discharge head; and a main scan moving device to move the carriage in a main scanning direction, wherein the liquid discharge head and the at least one member are connected.

13. A liquid discharge apparatus, comprising:

the liquid discharge device as claimed in claim 9; and a conveyor to convey a medium to the liquid discharge head, wherein the liquid discharge device discharges the liquid to the medium from the plurality of nozzles of the liquid discharge head.

14. A liquid discharge head, comprising:

a plurality of nozzles from which a liquid is discharged, a plurality of individual-liquid-chambers that communicate with the plurality of nozzles, respectively;

a supply-side common-liquid-chamber to supply the liquid to the plurality of individual-liquid-chambers;

a plurality of drainage channels that communicate with the plurality of individual-liquid-chambers, respectively;

a drainage-side common-liquid-chamber to drain the liquid in the plurality of drainage channels;

a supply-side filter disposed between the plurality of nozzles and the supply-side common-liquid-chamber;

a drainage-side filter disposed between the plurality of nozzles and the drainage-side common-liquid-chamber; and a plurality of partitions located upstream in the liquid flow direction of the drainage-side filter to define the plurality of drainage channels, wherein a first partition of the plurality of partitions is opposite filter holes of the drainage-side filter.

15. The liquid discharge head according to claim 14, wherein the drainage-side filter includes a plurality of filter regions spaced apart from one another by a second partition which is taller than the first partition.

16. The liquid discharge head according to claim 14, wherein the first partition is spaced apart from the drainage-side filter so as to define a common-drainage-channel, and the liquid in the plurality of drainage channels merge at the common-drainage-channel and collectively passes through the drainage-side filter.

17. A liquid discharge head, comprising:

a plurality of nozzles from which a liquid is discharged, a plurality of individual-liquid-chambers that communicate with the plurality of nozzles, respectively;

a supply-side common-liquid-chamber to supply the liquid to the plurality of individual-liquid-chambers;

a plurality of drainage channels that communicate with the plurality of individual-liquid-chambers, respectively;

a drainage-side common-liquid-chamber to drain the liquid in the plurality of drainage channels;

a supply-side filter disposed upstream from the plurality of nozzles in a liquid flow direction in which the liquid flows through the liquid discharge head;

a drainage-side filter disposed downstream from the plurality of nozzles in the liquid flow direction; and a plurality of partitions located upstream in the liquid flow direction of the drainage-side filter to define the plurality of drainage channels, wherein the plurality of partitions are located within a footprint of the drainage-side filter formed from projecting the drainage-side filter onto a plane parallel thereto.

18. The liquid discharge head according to claim 17, wherein the plurality of partitions are spaced apart from the drainage-side filter so as to define a common-drainage-channel, and the liquid in the plurality of drainage channels merge at the common-drainage-channel and collectively passes through the drainage-side filter.

* * * * *